US009067226B2

(12) United States Patent
Guthrie et al.

(10) Patent No.: US 9,067,226 B2
(45) **Date of Patent: *Jun. 30, 2015**

(54) SLURRY SPREADER HAVING A BASIN AND DRAINAGE NOZZLES

(71) Applicant: Brigham Young University, Provo, UT (US)

(72) Inventors: William S. Guthrie, Provo, UT (US); John M. Coyle, Farmington, UT (US); David O. Anderson, Bluffdale, UT (US); Charles Hope, Provo, UT (US)

(73) Assignee: Brigham Young University, Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/512,044

(22) Filed: Oct. 10, 2014

(65) Prior Publication Data

US 2015/0028127 A1 Jan. 29, 2015

Related U.S. Application Data

(63) Continuation of application No. 12/901,438, filed on Oct. 8, 2010, now Pat. No. 8,858,062.

(60) Provisional application No. 61/278,643, filed on Oct. 8, 2009.

(51) Int. Cl.

| | |
|---|---|
| ***B05B 1/20*** | (2006.01) |
| ***B28C 7/16*** | (2006.01) |
| ***B05C 5/00*** | (2006.01) |

(52) U.S. Cl.

CPC ... *B05B 1/20* (2013.01); *B28C 7/16* (2013.01); *B05C 5/005* (2013.01)

(58) Field of Classification Search

CPC ..... B05B 1/20; B28C 7/16; B05C 5/005

USPC ..... 366/53–59, 44, 68, 187; 239/159; 193/4–6, 10

See application file for complete search history.

(56) References Cited

U.S. PATENT DOCUMENTS

| | | | | | |
|---|---|---|---|---|---|
| 1,040,392 | A | * | 10/1912 | Ogle et al. | 193/2 R |
| 1,364,581 | A | * | 1/1921 | Ramsey | 193/6 |
| 2,011,894 | A | | 8/1935 | Etnyre | |
| 2,764,450 | A | * | 9/1956 | Rosener | 298/7 |
| 3,746,140 | A | * | 7/1973 | Schiffelbein | 193/5 |
| 4,007,821 | A | * | 2/1977 | Schiffelbein | 193/4 |
| 4,082,227 | A | | 4/1978 | McGrane et al. | |
| 4,684,062 | A | | 8/1987 | Bagwell | |
| 4,688,667 | A | * | 8/1987 | Peterson | 193/10 |
| 4,828,429 | A | | 5/1989 | Kirchner et al. | |
| 5,064,292 | A | | 11/1991 | Sutton | |
| 5,407,299 | A | * | 4/1995 | Sutton | 404/75 |

(Continued)

FOREIGN PATENT DOCUMENTS

| | | | |
|---|---|---|---|
| GB | 2277891 | A * | 11/1994 |
| WO | 2014/191766 | A1 * | 12/2014 |

*Primary Examiner* — Charles Cooley

(57) ABSTRACT

An apparatus can include a trough configured to be removably attached to a discharge chute and receive a slurry discharged therefrom. The apparatus can include a basin connected to a lower end of the trough, and can include a plurality of drainage nozzles disposed along a bottom of the basin and configured to concurrently distribute the slurry to a plurality of locations where the plurality of drainage nozzles includes an adjustable drainage nozzle.

19 Claims, 2 Drawing Sheets

(56) References Cited

U.S. PATENT DOCUMENTS

| | | | | |
|---|---|---|---|---|
| 5,531,518 | A * | 7/1996 | Alves | 366/68 |
| 6,106,141 | A * | 8/2000 | Bruun | 366/68 |
| 6,782,925 | B2 * | 8/2004 | Raposo et al. | 141/5 |
| 6,866,047 | B1 | 3/2005 | Marvin | |
| 7,178,657 | B1 * | 2/2007 | Hafen et al. | 193/4 |
| 7,217,053 | B2 * | 5/2007 | Alexander et al. | 401/139 |
| 7,506,672 | B2 * | 3/2009 | Manno | 141/86 |
| 8,336,585 | B2 * | 12/2012 | Royce | 141/332 |
| 8,522,948 | B1 * | 9/2013 | Galvin, IV | 193/10 |
| 8,858,062 | B2 * | 10/2014 | Guthrie et al. | 366/68 |
| 2004/0040518 | A1 * | 3/2004 | Lowe et al. | 119/652 |
| 2006/0239112 | A1 | 10/2006 | Graeber | |
| 2008/0175092 | A1 * | 7/2008 | Manno | 366/68 |
| 2009/0229706 | A1 * | 9/2009 | Royce | 141/331 |
| 2009/0229707 | A1 * | 9/2009 | Royce | 141/332 |
| 2011/0132996 | A1 * | 6/2011 | Guthrie et al. | 239/159 |
| 2015/0028127 | A1 * | 1/2015 | Guthrie et al. | 239/159 |

* cited by examiner

SLURRY SPREADER HAVING A BASIN AND DRAINAGE NOZZLES

CROSS REFERENCE TO RELATED APPLICATIONS

This application is a continuation of U.S. application Ser. No. 12/901,438, filed Oct. 8, 2010, which claims priority to and the benefit of U.S. Provisional Application 61/278,643 filed Oct. 8, 2009, both of which are incorporated herein by reference in their entireties.

BACKGROUND

Slurries are used in pavement construction and may comprise mixtures of portland cement, fly ash, lime, proprietary products, and/or other mineral or chemical admixtures, also called stabilizers, with water or another diluent. In the full-depth reclamation process, a method for rehabilitating pavements, road beds are typically prepared by pulverization, grading, and compacting before being topped with a wearing course such as concrete or asphalt. When full-depth reclamation in conjunction with stabilization is specified for a given project, the dry stabilizer, in powder form, is applied to the road base and/or sub-base layer(s) prior to the placement of a pavement wearing course. The powder is then mixed into the road base; the base is then compacted, graded, and shaped again as desired.

While this method of road bed treatment with a stabilizer, if properly applied, typically results in a suitable base for roads, the step involving the distribution of the dry powder almost inevitably generates fugitive dust. In addition to being harmful to humans and to the environment, the dust creates a cleanup problem, since some of the dust eventually settles and deposits itself on surrounding surfaces. For these reasons, the benefits of many forms of road bed stabilization are limited to open, rural areas. Although application in urban areas would be very desirable, the dust problems preclude the use of this technique. Because the clouds of fugitive dust are both inconvenient and harmful, it is advantageous to apply a slurry, instead of a powder, to a prepared road bed. Use of a slurry eliminates the clouds of dust and their associated problems. However, slurries are often imperfectly mixed and may contain debris from neglecting to properly clean the mixing chamber or exposure to the environment.

Due to the foregoing and other issues a need exists for an improved slurry spreader.

SUMMARY

An apparatus for distributing a slurry may include a trough configured to be removably attached to a discharge chute of a cement truck and receive a slurry discharged therefrom. The upper end of the trough may include a flange configured to extend under the discharge chute and prevent spillage therefrom. A enclosed basin may be connected to a lower end of the trough proximate to a midpoint of the enclosed basin such that the enclosed basin is substantially perpendicular to the trough.

An aperture formed into the enclosed basin may enable the slurry to flow from the trough into the enclosed basin. The enclosed basin may also include at least one covered access port disposed at an end or top thereof that can be opened to provide access to the interior of the enclosed basin and closed to prevent contamination of the slurry.

A plurality of adjustable drainage nozzles may be disposed along the bottom of the enclosed basin that concurrently distribute the slurry to a plurality of locations and thereby facilitate efficient coverage of a roadbed with the slurry.

In certain embodiments, the enclosed basin is cylindrical and the trough is a half-pipe and/or a radius of the trough is substantially equal to a radius of the enclosed basin. The slurry spreader may include a screen attachment that covers the aperture and filters the slurry.

With respect to the foregoing description, it is to be understood that the optimal dimensional relationships for the parts of the slurry spreader, to include variations in size, materials, shape, form, function and manner of operation, assembly, and use are deemed readily apparent to one skilled in the art. All equivalent relationships to those illustrated in the drawings and described in the specification are intended to be encompassed by the present design. Therefore, the foregoing is intended to be considered as merely illustrative of the principles of the slurry spreader. Furthermore, since numerous modifications and alterations will readily occur to those skilled in the art, it is not intended to limit the design to the exact construction and operation shown and described; accordingly, all suitable modifications and equivalents that may be resorted to should be considered to fall within the scope of the invention.

BRIEF DESCRIPTION OF THE DRAWINGS

In order to describe the manner in which the above-recited and other advantages and features can be obtained, a more particular description of the subject matter briefly described above will be rendered by reference to a specific embodiment which is illustrated in the appended drawings. Understanding that these drawings depict only a typical embodiment and are not therefore to be considered to be limiting in scope, the embodiment will be described and explained with additional specificity and detail through the use of the accompanying drawings in which.

DETAILED DESCRIPTION

Figure 1:
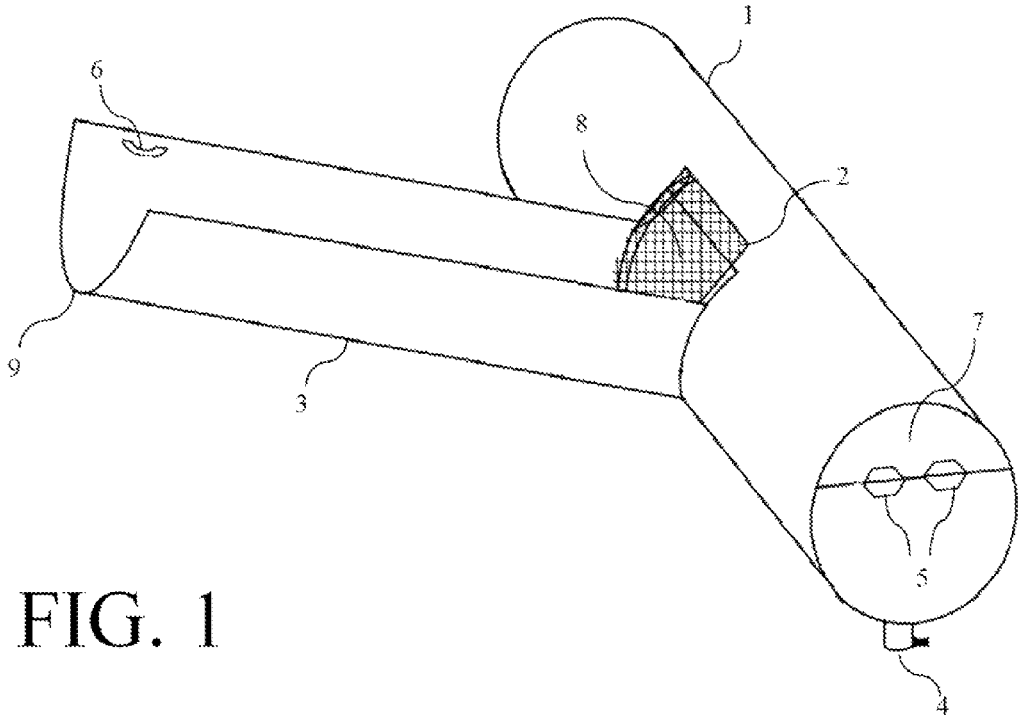
FIG. 1 is a perspective view drawing illustrating one embodiment of a slurry spreader.
Figure 2:
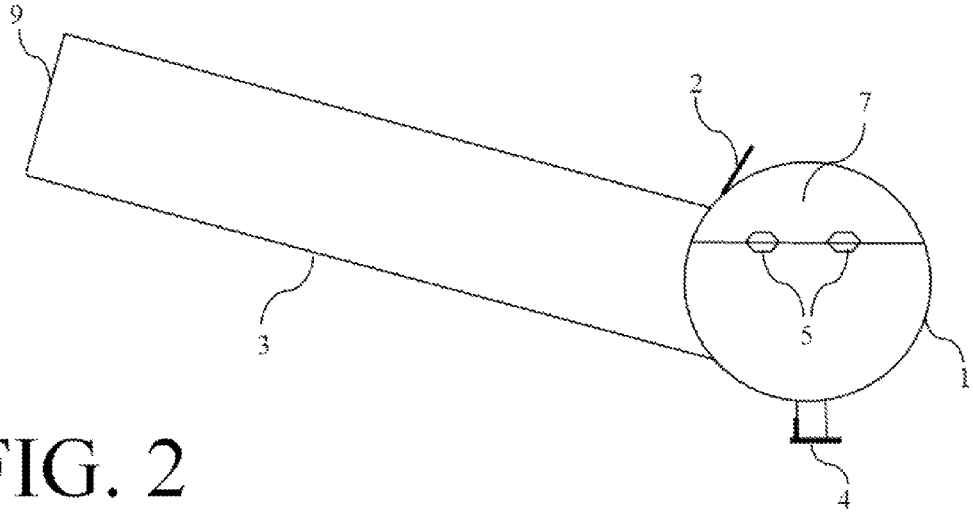
FIG. 2 is a side view drawing illustrating one embodiment of the slurry spreader, as seen from the side of a basin with an attached covered access port.
Figure 3:
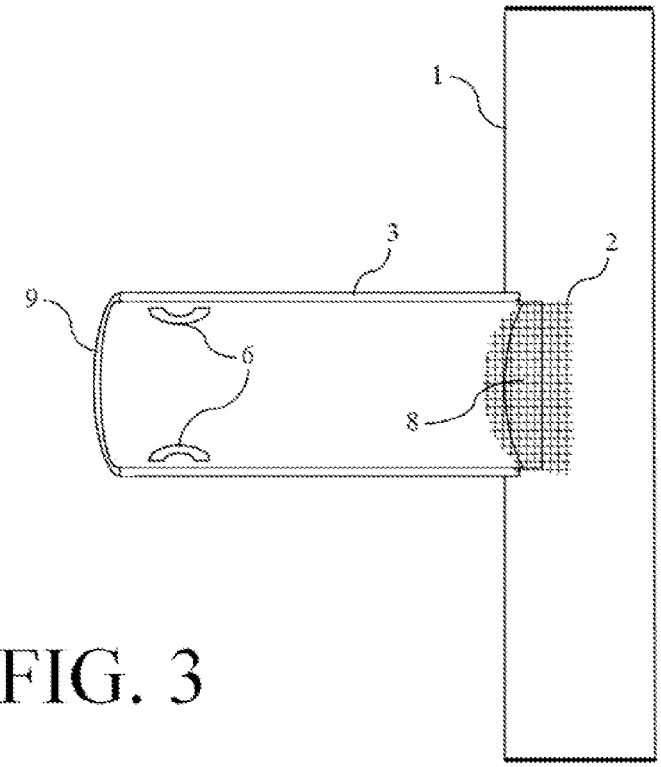
FIG. 3 is a top view drawing illustrating one embodiment of the slurry spreader.
Figure 4:
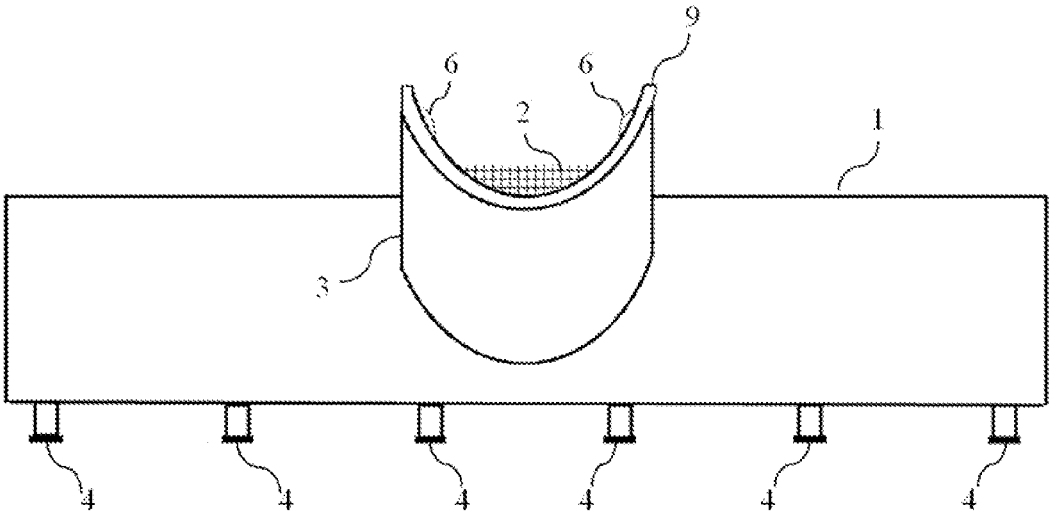
FIG. 4 is a rear view drawing illustrating one embodiment of the slurry spreader when the device is mounted in position for use.

FIG. 1 illustrates a perspective view of one embodiment of a slurry spreader. FIGS. 2, 3, and 4 illustrate the slurry spreader from the side, top, and rear (the side proximal to the discharge chute when the slurry spreader is mounted), respectively.

As depicted in FIGS. 1-4, a half-pipe trough 3 may be perpendicularly attached to an enclosed basin 1 that may be isolate the slurry from the environment while the slurry spreader is in use. A screen 2 may be removably attached at the junction of the trough 3 and the basin 1 and filter a slurry that passes down the trough 3, through the opening 8, and into the basin 1. Filtering the slurry may ensure that the slurry is reasonably homogeneous previous to distribution of the slurry to the road bed. The use of the screen 2 instead of a motorized mixer or pump may eliminate the need for moving parts or wiring from the spreader to the truck.

Attachment devices 6 may be attached to the trough 3 in order to secure the trough to the discharge chute of a ready-mix truck while the slurry spreader is in use. Adjustable nozzles 4 may be mounted lengthwise across the bottom of the basin 1 and used to discharge the slurry to the road or other desired surface. Hinges 5 may attach to a cover for one or more covered access port(s) 7 on the side or top of the basin 1 to enable access to the slurry and clean the slurry spreader after use.

The slurry spreader described herein attaches to the discharge chutes that are standard on ready-mix trucks. When attached to such a discharge chute, the slurry spreader directs the flow of slurry from the truck into the slurry spreader's closed-top basin. A screen situated at the entry point of the basin prevents debris lumps and irregular nodules in the cement mixture from entering the basin. The slurry is then discharged onto the road or other desired surface through a plurality of adjustable drainage nozzles situated at the bottom of the basin.

Referring again to the Figures, an apparatus for distributing a slurry may include a trough 3 configured to be removably attached to a discharge chute of a cement truck and receive a slurry discharged therefrom. The upper end of the trough may include a flange 9 configured to extend under the discharge chute and prevent spillage therefrom. A enclosed basin 1 may be connected to a lower end of the trough proximate to a midpoint of the enclosed basin such that the enclosed basin 1 is substantially perpendicular to the trough 3.

An aperture 8 formed into the enclosed basin 3 may enable the slurry to flow from the trough into the enclosed basin. The enclosed basin 3 may also include at least one covered access port disposed at an end or the top thereof that can be opened to provide access to the interior of the enclosed basin and closed to prevent contamination of the slurry.

A plurality of adjustable drainage nozzles 4 may be disposed along the bottom of the enclosed basin that concurrently distribute the slurry to a plurality of locations and thereby facilitate efficient covered access portage of a roadbed with the slurry.

In certain embodiments, the trough 3 is a half-pipe and/or a radius of the trough is substantially equal to a radius of the enclosed basin. The slurry spreader may include a screen attachment 2 that covered access ports the aperture and filters the slurry.

In various embodiments and configurations, the depicted slurry spreader may provide certain advantages and benefits. For example, the spreader may be attached to a discharge chute of a ready-mix truck and facilitate distributing the slurry to a selected location by positioning the discharge chute. Furthermore, the slurry spreader's basin may be closed to prevent contamination and opened to facilitate cleaning In certain embodiments, the relatively small size of the spreader enables as few as one or two people to attach the spreader to, or remove it from, the chute of a ready-mix truck in a matter of seconds. Other slurry distributors generally cannot be engaged and disengaged so quickly by so few people.

The purpose of the foregoing description is to enable the U.S. Patent and Trademark Office and the general public—especially scientists, engineers, and practitioners in the art who are not familiar with patent terminology—to quickly determine from a cursory inspection the nature and essence of the technical disclosure of the application. The description and the abstract are not intended to define the slurry spreader as specified by the claims, nor are they intended to limit the scope of the claims.

What is claimed is:

1. An apparatus, comprising:

a trough configured to be removably attached to a discharge chute and receive a slurry discharged therefrom;

a basin connected to a lower end of the trough;

an aperture formed in the basin and configured to enable the slurry to flow from the trough into the basin;

a screen attachment disposed within the aperture at a junction between the basin and the trough and configured to filter the slurry; and a plurality of drainage nozzles disposed along a bottom of the basin and configured to concurrently distribute the slurry to a plurality of locations, the plurality of drainage nozzles including an adjustable drainage nozzle.

2. The apparatus of claim 1, wherein the trough has a half-pipe shape.

3. The apparatus of claim 1, wherein the basin is an enclosed basin.

4. The apparatus of claim 1, wherein the basin is an enclosed basin having a cylindrical shape.

5. The apparatus of claim 1, wherein the trough has a radius substantially equal to a radius of the basin.

6. The apparatus of claim 1, wherein the trough has a front including a flange configured to extend under the discharge chute.

7. The apparatus of claim 1, wherein the basin is an enclosed basin including at least one covered access port, the at least one covered access port configured to be opened and configured to be closed.

8. The apparatus of claim 1, wherein the trough is connected to the basin proximate to a midpoint of the basin.

9. The apparatus of claim 1, wherein the trough is connected to the basin such that the basin is substantially perpendicular to the trough.

10. The apparatus of claim 1, wherein the trough is configured to be removably attached to the discharge chute of a ready-mix truck.

11. An apparatus, comprising:

a trough configured to be removably attached to a discharge chute and receive a slurry discharged therefrom;

a basin connected to a distal end of the trough;

an aperture formed in the basin at the distal end of the trough and configured to enable the slurry to flow from the trough into the basin;

a screen attachment disposed within the aperture and configured to filter the slurry; and a plurality of drainage nozzles disposed along a bottom of the basin and configured to concurrently distribute the slurry to a plurality of locations.

12. The apparatus of claim 11, wherein the basin is an enclosed basin.

13. The apparatus of claim 11, wherein the trough has a radius substantially equal to a radius of the basin.

14. The apparatus of claim 11, wherein the plurality of drainage nozzles including an adjustable drainage nozzle.

15. The apparatus of claim 11, wherein the trough has a front including a flange configured to extend under the discharge chute.

16. The apparatus of claim 11, wherein the basin is an enclosed basin including at least one covered access port, the at least one covered access port configured to be opened and configured to be closed.

17. The apparatus of claim 11, wherein the trough is connected to the basin proximate to a midpoint of the basin.

18. The apparatus of claim 11, wherein the trough is connected to the basin such that the basin is substantially perpendicular to the trough.

19. The apparatus of claim 11, wherein the trough is configured to be removably attached to the discharge chute of a ready-mix truck.

* * * * *